US005687551A

United States Patent [19]

Mustain et al.

[11] Patent Number: 5,687,551

[45] Date of Patent: Nov. 18, 1997

[54] PRODUCT HOLDING HOPPER AND POUCH EXPANDER FOR FILLING POUCHES AND METHODS

[75] Inventors: Steven F. Mustain, Milford, Ohio; Joseph D. Greenwell, Florence, Ky.; Jerome Brugger, Melbourne, Ky.; Michael E. Myers, Bellevue, Ky.; Richard A. Schaeffer, Maineville, Ohio

[73] Assignee: R. A. Jones & Co. Inc., Cincinati, Ohio

[21] Appl. No.: 338,872

[22] Filed: Nov. 14, 1994

[51] Int. Cl.[6] ..... B65B 1/06; B65B 7/06; B65B 39/02; B65B 43/34

[52] U.S. Cl. ..... 53/468; 53/469; 53/570; 53/384.1; 53/262; 141/10; 141/114; 141/316; 141/317

[58] Field of Search ..... 53/455, 459, 562, 53/570, 261, 262, 384.1, 468, 469, 255; 141/10, 114, 316, 317

[56] References Cited

U.S. PATENT DOCUMENTS

| | | | |
|---|---|---|---|
| 2,031,005 | 2/1936 | Renfroe | 53/262 |
| 2,269,532 | 1/1942 | Howard | 53/455 |
| 2,292,660 | 8/1942 | Renfroe | 53/262 |
| 2,330,361 | 9/1943 | Howard | 53/455 |
| 2,342,369 | 2/1944 | Ransbottom | 53/262 |
| 2,923,111 | 2/1960 | Selock | 53/455 |
| 3,453,799 | 7/1969 | Cloud et al. | 53/562 X |
| 3,478,492 | 11/1969 | Cloud et al. | 53/562 X |
| 3,563,001 | 2/1971 | Cloud etal. | 53/562 |
| 3,821,873 | 7/1974 | Benner, Jr. et al. | 53/562 X |
| 4,232,504 | 11/1980 | Dieterlen et al. | 53/562 X |
| 4,344,269 | 8/1982 | Dieterlen et al. | 53/455 X |
| 4,702,289 | 10/1987 | Benner, Jr. et al. | 53/562 X |
| 4,848,421 | 7/1989 | Froese et al. | 141/114 |
| 5,320,146 | 6/1994 | Stevie . | |
| 5,322,096 | 6/1994 | Tetenborg et al. | 141/10 X |

*Primary Examiner*—Horace M. Culver
*Attorney, Agent, or Firm*—Wood, Herron & Evans

[57] ABSTRACT

A pouch filling apparatus for filling pouches with product as the pouches travel around a filler wheel includes a hopper wheel carrying a plurality of hoppers over a sector of the filler wheel empty of pouches. The filler wheel carries a plurality of product dispensing units having an upper accumulation chamber. The hopper wheel and the filler wheel counter-rotate in timed relation so that individual product dispensing units and hoppers cross paths at a product transfer station to allow product to be dropped from a hopper into the accumulation chamber of a product dispensing unit. The filler wheel then rotates to a filling station and the product is released from the accumulation chamber into a pouch travelling along the pouch conveyor. In one embodiment, the product dispensing unit includes a lower expandable cone assembly which is lowered into the pouch at the filling station and expanded before the product is released from the accumulation chamber to form the pouch mouth into a substantially circular configuration. Alternative pouch expanders and product accumulation apparatus are described, as well as methods.

55 Claims, 9 Drawing Sheets

S
214
CL-1
206

200
213
210
211
208
206
203
205b
205
2a
2c 202
204
199
201
CL-2
CL-1
16
19
18
12
13
212
10
11
14
15
209
211
207
205
205a
2a
2b

PRODUCT HOLDING HOPPER AND POUCH EXPANDER FOR FILLING POUCHES AND METHODS

This application relates to pouch filling and more particularly to methods and apparatus for increasing the speed at which pouches may be filled around a filling wheel and the number of operations that may be performed around the filler wheel, and to an apparatus for facilitating the passage of products into the pouches.

In a pouch form, fill, and seal machine to which the present invention is directed, a web is folded upon itself longitudinally and is transversely sealed at spaced intervals to form pouches between the seals. This transversely sealed web is fed to a filling apparatus. The filling apparatus may take the form of a horizontally disposed filler wheel turning about a vertical axis and having spaced vertical lands on which the seals are positioned. The lands are spaced with respect to the pouches such that the pouches are slightly opened as they are positioned on the lands. Suction cups behind each pouch may be provided to assist in this initial opening of the pouches. Alternately, the pouches are held by grippers along the edge seals which move the pouches seals closer together, allowing the upper end mouth to open.

In the past, it has been normal to utilize a product feeder which receives a predetermined or weighed measure of product and drops it directly into the pouches through a loading tube. Apparatus of this type has the disadvantage that the dropping of the product fill into the loading tube must occur at a location or sector around the filler wheel where a pouch lies directly underneath the loading tube. Otherwise, the product would flow out of the loading tube or spout onto the floor. With machines of this type, the timing of the weighing and loading of the loading tubes has to be coordinated with the speed of the pouches. The frequency at which the product can be dropped from a hopper above the filler wheel down through the loading tube is a limiting factor on pouch speed. Thus it is difficult to increase the pitch (or number of pouches for a given web length) or to increase pouch web speeds as the filler may not be able to keep up.

Moreover, it will be appreciated that the train of pouches generally runs halfway around the filler wheel, with the pouches coming in tangent to the wheel at one point and then leaving the wheel at a tangent which is about 180° around the wheel. This means that essentially only one, or at the most two, filling devices can be utilized; with pouch opening, fill tube insertion and product dropping occurring in the first 90° sector of orientation on the filler wheel, and product settling on the next 90° sector. As a result, the remaining periphery of the wheel was lost to any additional processing of the pouches or the product therein.

With specific regard to the loading tube used in conjunction with these apparatus, it has been common in the past to use loading tubes with diameters that are sufficiently small to enter the pouches during the filling operation. Currently, the pouches are gripped at their edges and the sides moved together so that the pouches opened into somewhat of a diamond-shaped or elliptical configuration, thus providing an opening for the small loading tube.

But the relatively small loading tube and/or the less than optimum pouch opening impede the filling of large or bulky product into the pouch.

Another common method of opening pouches to receive a loading tube is shown in U.S. Pat. No. 3,821,873 to Benner, Jr. et al., assigned to the assignee of the present invention. The Benner patent describes air nozzles 84, 86 used to open the top, unsealed side of the pouch by forcing a stream of air into the pouch. At about the same time, the inner side of the pouch becomes attached to the mouth of a suction nozzle 92 and is drawn inwardly. The nozzle 92 thus contributes to the opening of the upper side of the pouch prior to filling. This, however, does not solve the problem of loading larger or bulky product into the pouch.

Another advance with regard to the pouch opening operation was made by Froese et al. in U.S. Pat. No. 4,848,421 which is assigned to the assignee of the present invention. Froese et al. show a loading tube in the form of a "duck-billed" spout having two arcuately shaped halves which converge toward one another at their lower ends. The two spout halves are expanded once they have been lowered into an open pouch at the pouch filling station. This design allowed the small, unexpanded discharge opening of the loading tube or spout to be easily lowered into the open pouch and then expanded to facilitate the free flow of product through the spout and into the pouch. The expansion of the outlet of this duck-billed spout allowed the loading operation to be performed at a much higher rate than was possible with previous loading tubes since this larger expanded outlet allowed faster flow of product through the spout. Although this design has been useful, packagers are now requiring increased packaging speeds and/or further processing capabilities requiring additional processing stations around the filler wheel.

In these regards, the "duck-billed" spout design has certain limitations. First, the expanded position of the two-piece duck-billed spout opens the pouch mouth into a shape which is arcuate at two ends and straight along two sides. This opening configuration is not universally acceptable for bulky product of varying shape or size. Second, the mechanism for lowering the duck-billed spout into the pouches travelling along the pouch conveyor, expanding the spout, filling the pouch, contracting the spout, and finally raising the spout is relatively complicated. This mechanism also does not easily allow for the positioning of additional filling and/or processing apparatus around the filler wheel.

Accordingly, it has been one objective of the invention to provide an improved pouch filling apparatus wherein pouches may move along a pouch conveyor and be filled with product at higher speeds than were heretofore achieved.

It has been another objective of the invention to more efficiently utilize the space surrounding the periphery of the filler wheel so as to further increase the speed at which pouches may travel along the wheel and/or to accommodate additional processing or filling apparatus around the filler wheel.

It has been still another objective of the invention to provide improved apparatus for opening pouches to receive bulky or varied-shaped product more efficiently and quickly than was heretofore possible.

SUMMARY OF THE INVENTION

To these ends, a preferred embodiment of the present invention contemplates the interposition of a product dispensing unit, including an accumulation chamber between a rotatable product hopper wheel and an underlying rotatable pouch filler wheel. The rotatable hopper wheel is preferably oriented above a sector of the filler wheel which is void of pouches, and is operable to drop measured product fills into the accumulation chambers moving with the filler wheel. The accumulation chambers hold the product until the filler wheel mates with the pouches, then the product is dropped from the chamber into the pouches. Thus, it is not necessary that the hopper be disposed over a pouch when it drops product into the accumulation chamber. This permits more effective use of the entire periphery of the filler wheel; i.e. product is dropped into the accumulation chambers at a time when the hoppers are not disposed over a pouch, thus permitting faster filling and increased pouch speeds.

The hopper wheel has a plurality of hoppers situated on its top surface to receive predetermined amounts of product from, for example, a combinational scale filling system. While a combinational scale filling system is specifically described, other types of product feeders might also be used such as, for example, augers, cup feeders, weigh belt feeders, vibratory feeders or still other product feeders. The rotatable filler wheel is mounted below a peripheral sector of the hopper wheel and has a plurality of product dispensing units mounted on its top surface in angularly spaced positions. As noted, the product dispensing units each have an upper accumulation chamber for collecting, holding and releasing product. As the filler wheel rotates, the product dispensing units pass beneath the hopper wheel such that the accumulation chambers rotate in timed relation with and directly beneath discharge openings of the hoppers on the hopper wheel for receiving product fill. The hopper wheel may be situated at the previously unusable position, i.e. the sector above the filler wheel periphery having no pouches in place, because the accumulation chambers at the upper end of the product dispensing units can hold the product until an appropriate drop time. Thus, the accumulation chambers accumulate product and hold it until the filler wheel rotates through an arcuate sector to reach the filling station about a peripheral sector of the filler wheel where pouches are in place.

Moreover, other hopper wheels can be added around the filler periphery and the accumulation chambers can be filled anywhere on this periphery, thus further accommodating increased pouch speeds, and/or an increased number of product feeds. Filling of the accumulation chambers, of course, can take place while loading pouches.

In another embodiment of the invention, the product dispensing unit includes an expandable cone which is lowered into the pouch at the filling station. The cone is defined by a plurality of resilient or spring-loaded fingers. A descending spout is lowered into the cone, expanding its fingers and the mouth of the pouch into a circular opening. Thereafter, product is released from the accumulation chamber and travels through the spout and the expanded cone into the pouch. In this embodiment of the invention as described in detail herein, the product dispensing unit thus includes three major components. The first of these components is an upper product accumulation chamber; the second component is an intermediate product funnel or spout, and; the third component is a lower expandable cone.

It will be appreciated that expandable cone apparatus can be used to facilitate container openings in many applications whether or not the accumulation chamber is used. Conversely, the accumulation features described herein can be used without the expandable cone apparatus described herein.

The expandable cone is preferably formed with a plurality of at least three distinct, resilient or spring loaded side wall portions or fingers which are expanded by a lower tubular spout portion of the product funnel. The spout's lower end is moved into the cone after the apex end of the cone has been initially inserted into the top of the pouch and further movement of the cone into the pouch is stopped. As the product funnel reaches its lowermost position inside the cone, the fingers expand the pouch mouth fully into a circular configuration which is the optimum shape for receiving relatively large or bulky items of varied shapes. The accumulation chamber or hopper wheel at the top of the funnel is then caused to release the measured amount of product that it previously received from a product hopper at the product transfer station.

In this embodiment, the product funnel and expandable cone are both slidably connected to vertical rods extending upwardly from the top surface of the filler wheel. The expandable cone and product funnel are also driven by independent means to facilitate both joint and relative motion necessary to expand, fill and withdraw from the pouch. Preferably, the cone and spout are initially withdrawn together to avoid the cone's capturing and withdrawing product as it closes. An alternative pouch expander in a rectilinear configuration is provided for use when the pouch mouth must be expanded into other than a circular shape. Its operation, however, is similar to that of the cone-shaped expander.

The several objectives and features of the invention will become more readily apparent from the following detailed description of preferred embodiments taken in conjunction with the accompanying drawings in which.

Figure 1:
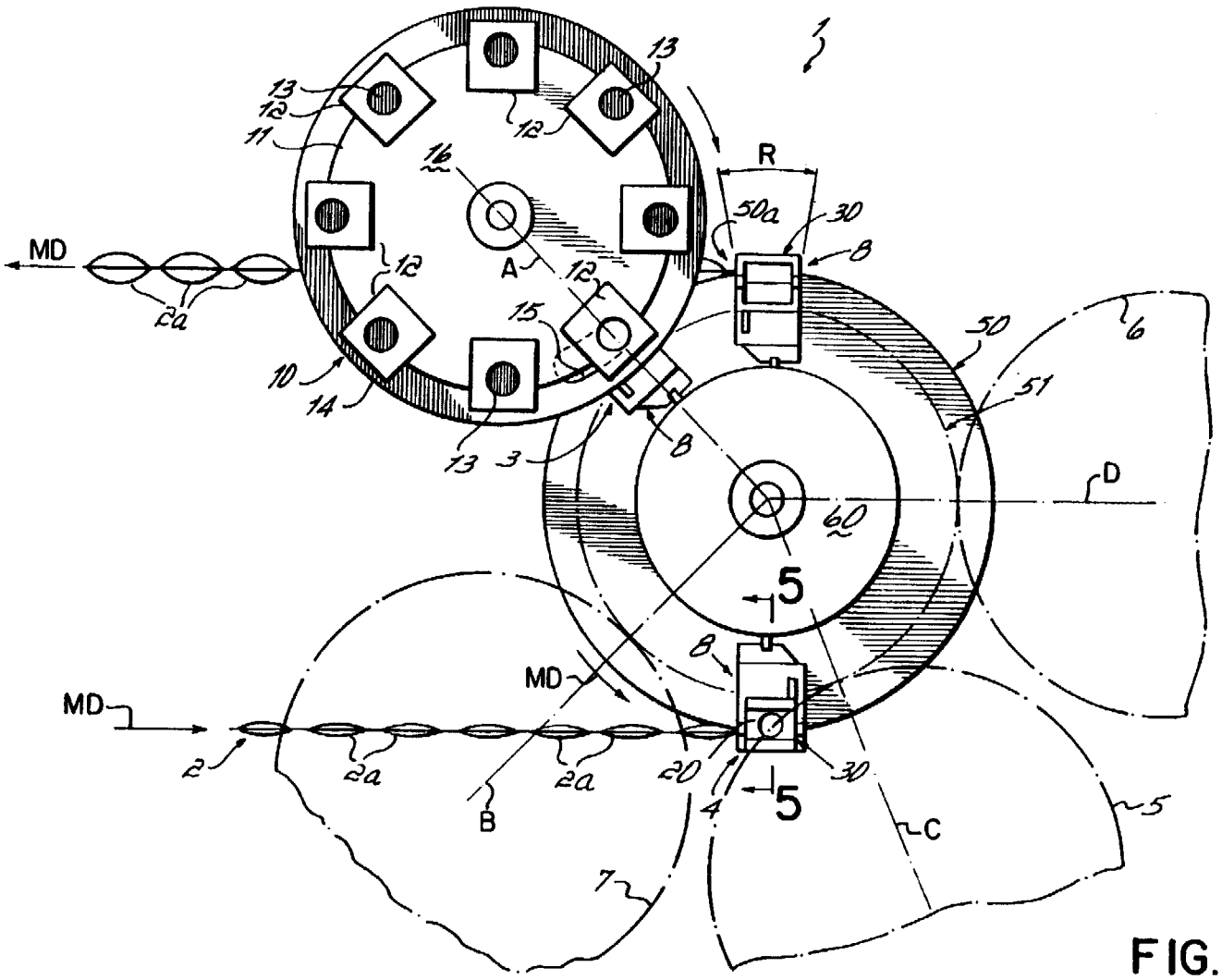
FIG. 1 is a diagrammatic top view of a pouch filling apparatus according to the present invention.
Figure 9:
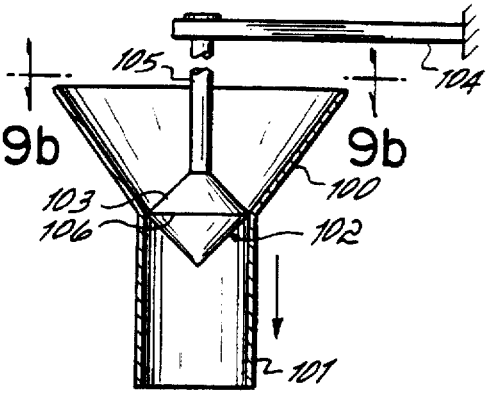
FIG. 9 is an elevational view of another form of product accumulation chamber and valve or gate; FIG. **9*a* is an elevational view similar to FIG. 9** but showing the accumulation valve in an open condition.
Figure 10:
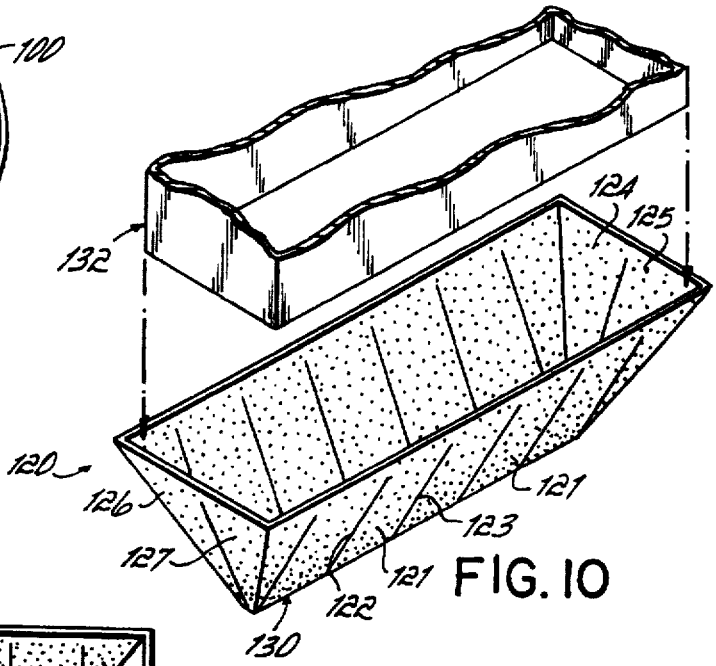
Figure 11:
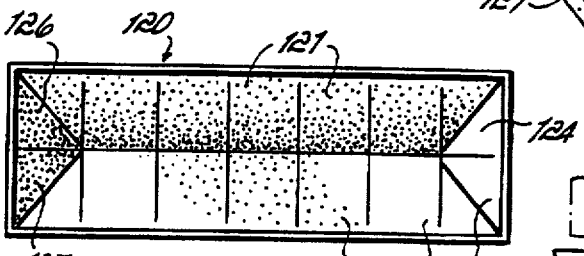
Figure 12:
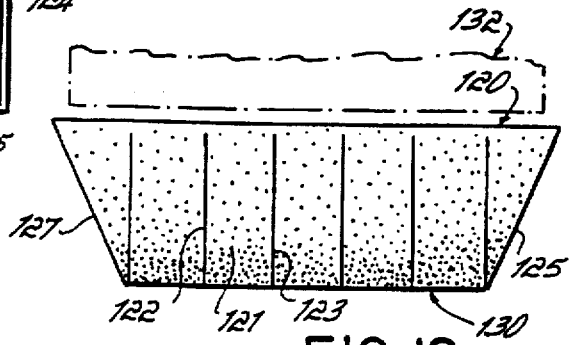
Figure 13:
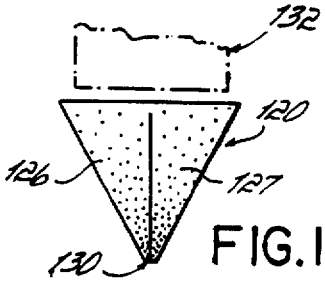
Figure 14:
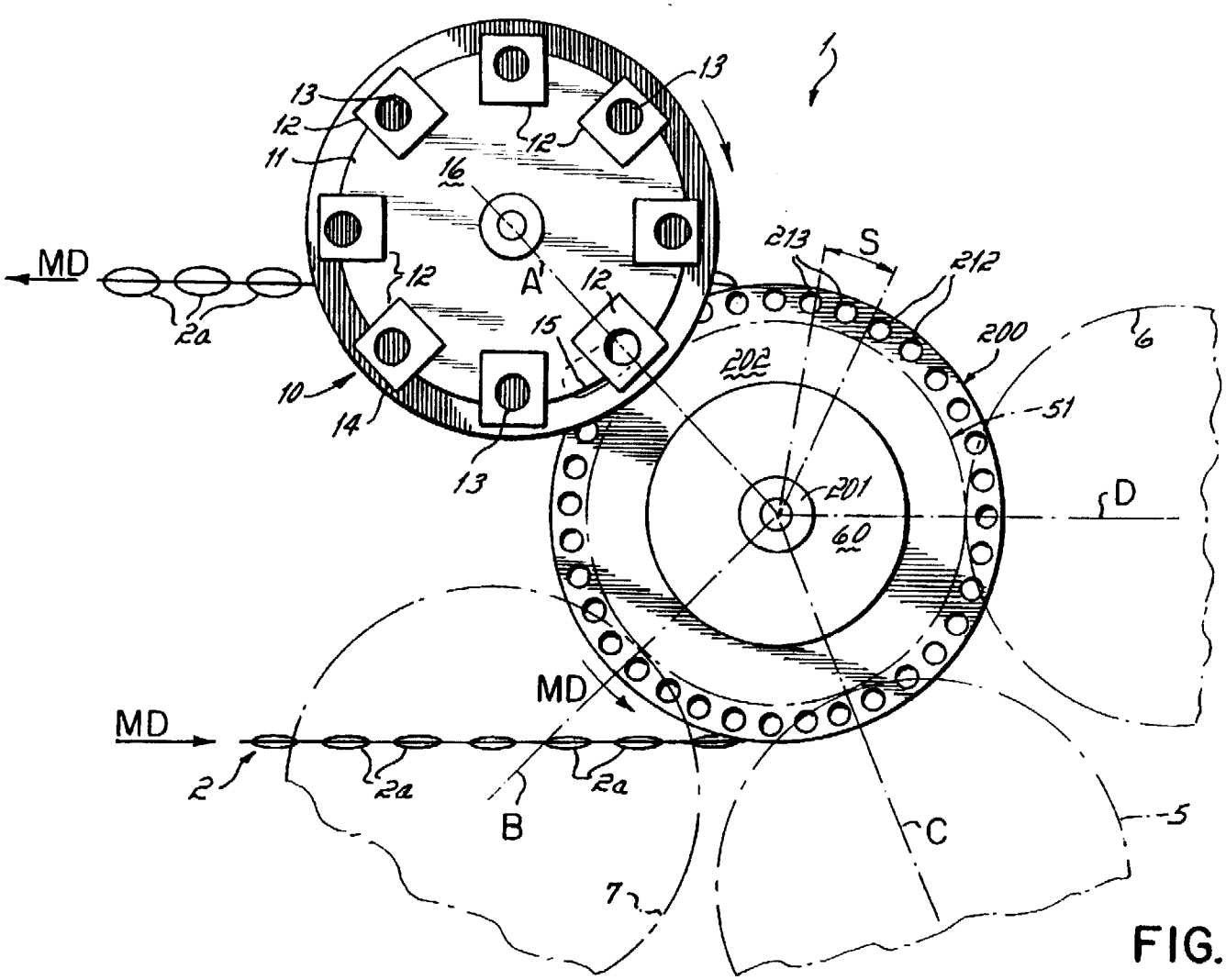
Figures 15, 16:
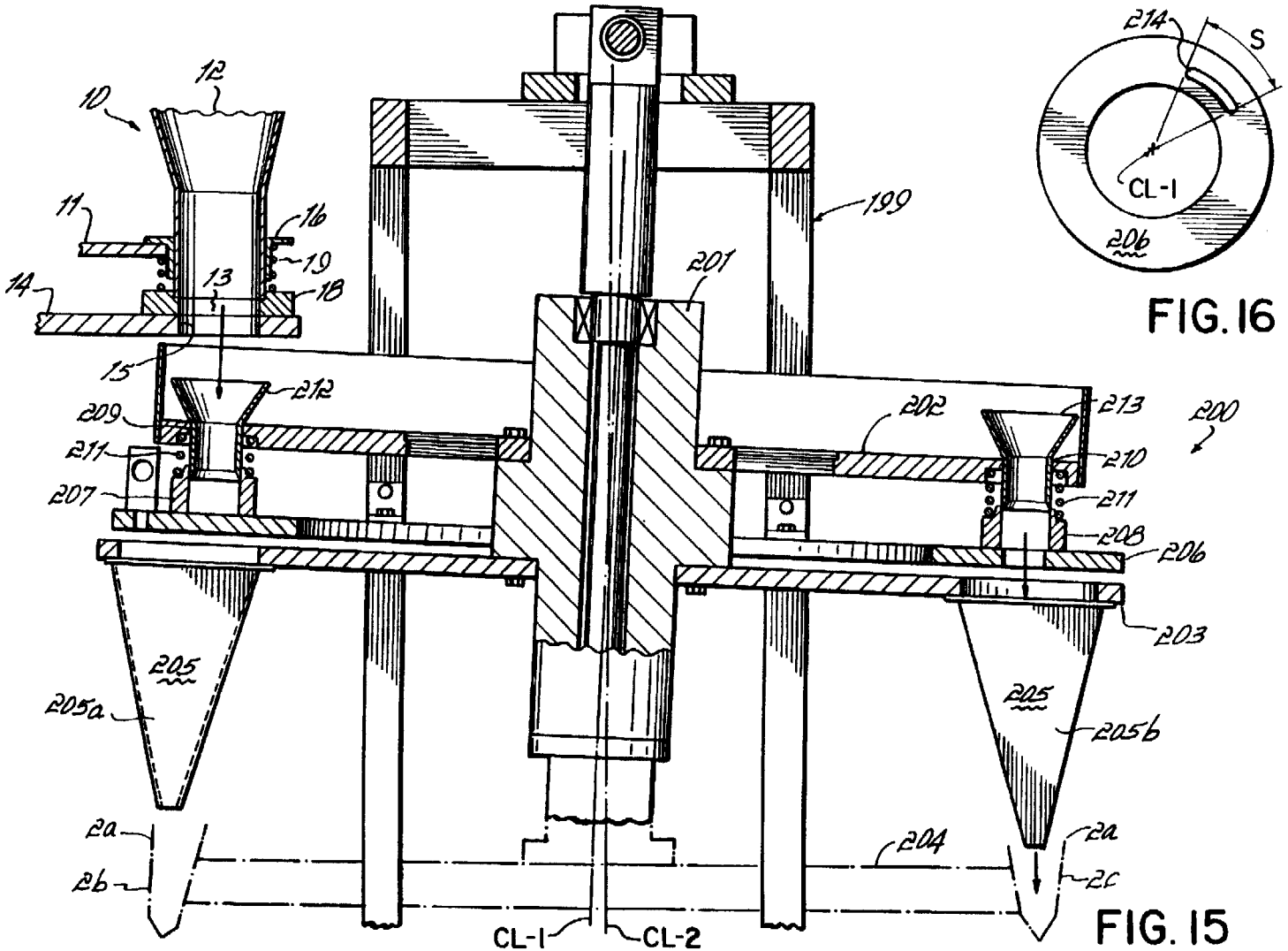

FIG. **9*b* is a plan view of the chamber and valve of FIG. 9 taken along lines 9*b*—9*b*** thereof;

FIG. 10 is a perspective view of an alternative embodiment of a pouch expander;

FIG. 11 is a plan view of the embodiment of FIG. 10;

FIG. 12 is an elevational view of the embodiment of FIG. 10;

FIG. 13 is an end view of the embodiment of FIG. 10;

FIG. 14 is a plan view similar to FIG. 1 but illustrating an alternative embodiment of the invention;

FIG. 15 is an elevational view in partial cross-section, further illustrating the embodiment of FIG. 14; and FIG. 16 is a plan view of the snake plate shown in FIG. 15.

GENERAL ORGANIZATION

Referring first to FIG. 1, a pouch filling apparatus 1 includes a hopper wheel assembly 10 and a filler wheel assembly 50 disposed beneath the hopper wheel 10 such that the outer peripheral portions overlap on axis A, for example, as shown. The wheel assemblies counter-rotate as viewed in FIG. 1 in timed relation to one another. Product is transferred at a transfer station 3 from a hopper 12 on the hopper wheel assembly 10 to a product dispensing unit 8 on the filler wheel assembly 50 from where product is to be deposited into pouches at a pouch filling station 4. A pouch conveyor 2 forms a train of pouches 2*a* wrapped around filler wheel 50 through about 180 degrees. The hopper wheel assembly 10 overlaps a part of filler wheel 50 in a sector free of pouches between the incoming and exiting portions of the pouch conveyor 2, as shown. This location of the hopper wheel assembly 10 (along axis A) utilizes space which, in the past, has been unusable since the hopper wheel assembly 10 previously had to be positioned directly adjacent the pouch filling station 4 so that when product was dropped from the hopper, it fell directly into pouches at the pouch filling station 4.

The invention, however, as further shown in FIG. 1, includes a plurality of product dispensing units 8 rigidly mounted on top of the horizontally mounted rotatable filler wheel assembly 50. These receive and hold product transferred from the hopper wheel assembly 10 to the product dispensing units 8 at the product transfer station 3, and carry the product about to filling station 4. That is, once the product has been deposited into a product dispensing unit 8, the continuously rotating filler wheel rotates to the pouch filling station 4 where the product is deposited into a registered pouch 2*a* (FIGS. 4 and 5) carried by the pouch conveyor 2. The filled pouch 2*a* then continues on the pouch conveyor 2 around the filler wheel assembly 50. If necessary, the pouch train may be further processed by the application of further hopper wheel or other product feed assemblies 5 (axis C), 6 (axis D), and/or 7 (axis B) for example. For illustrative purposes, three additional processing means are shown, however, the specific number of additional processing means utilized will depend on the processing needs of a specific product and the space available around the filler wheel. After all filling and processing is finished, the pouch conveyor 2 exits the filler wheel assembly 50 at 50*a* and continues on to the pouch sealing and packaging apparatus downstream of the filler wheel assembly 50. Of course, it will be appreciated that each product dispensing unit 8 is operably inserted into a pouch (See FIG. 3, cone 41) from filling station 4, around to a pouch exit position in the arcuate segment marked "R" (FIG. 1). Accordingly, product can be dropped directly from hoppers 12 into open product dispensers 8 from assemblies 5 (axis C) and 6 (axis D) for example. Product dispensers 8 to be filled by hopper assembly 7 (axis B) and hopper wheel 10 (axis A), however, must be closed as no pouch is in position under such dispensers 8.

For clarity, only three product dispensing units 8 are shown on the filler wheel assembly 50. However, it should be understood that several more product dispensing units 8 will ordinarily be necessary to service the number of pouches 2*a* travelling around the filler wheel 51. The particular number of product dispensing units 8 which are necessary will depend on the pitch of the pouches travelling around the filler wheel assembly 50, i.e. the distance traversed by each pouch in the machine direction "MD".

If the pitch of the train of pouches is great enough, there will be room on the filler wheel assembly 50 for enough product dispensing units 8 to service each pouch as it proceeds through the filling station 4 from the single hopper wheel 10. If the pitch of the train of pouches does not allow for a one-to-one correspondence between the number of product dispensing units 8 and hoppers 12, for the pouches passing through the filling station 4, then additional hopper wheel assemblies 5, 6 and/or 7 are particularly useful for filling alternate or sequential product dispensing units 8. The hopper wheel assemblies 5, 6 or 7 may, for example, be used to service every other or every third pouch coming around the filler wheel 50. Also, additional assemblies could be used to add additional components to already partially filled pouches. It will be appreciated that faster pouch filling speeds may also be attained by means of directing the pouch train 2 about additional rotating filler wheel assemblies operatively associated with additional hopper wheel assemblies.

The Pouch Train

The pouch conveyor 2 generally comprises a plurality of typical scissor-like grippers (not shown), each holding a pouch along its opposite side edges and operable to squeeze or bias the edges toward each other to open the pouch mouth. The grippers are carried on appropriate chains 56, 57 and means are provided to operate them at filler station 4 to open the pouch mouths.

The gripper units preferably take the form of those disclosed in U.S. Pat. No. 4,956,964 to Jones, deceased et al., entitled "Adjustable Pouch Form, Fill, Seal Machine" and assigned to the assignee of the present invention. U.S. Pat. No. 4,956,964('964) is hereby expressly and fully incorporated by reference herein.

The grippers disclosed in the Jones'964 patent have a molded plastic frame which includes an integrally molded leading fixed jaw. The frame has a pair of vertically spaced horizontal rods to which a trailing jaw is slidably mounted. Each jaw has a fixed clamp and a movable clamp with the movable clamp mounted on the end of a rod and the other end of which carries a cam follower roller. The fixed jaw is substantially identical to the movable jaw except that the clamping element of the fixed jaw is L-shaped to permit the rod of the fixed jaw to be at a lower position than the rod of the movable jaw. By vertically spacing the respective rods and followers, the jaws can be manipulated by respective vertically spaced cams without interference. Two cams are mounted adjacent the pouch conveyor to capture a pouch and, downstream from the sealing station, to release the pouch. Of course, any other suitable form or means to transport the pouches could be used in conjunction with the invention.

The Hopper Wheel Assembly

Figure 2:
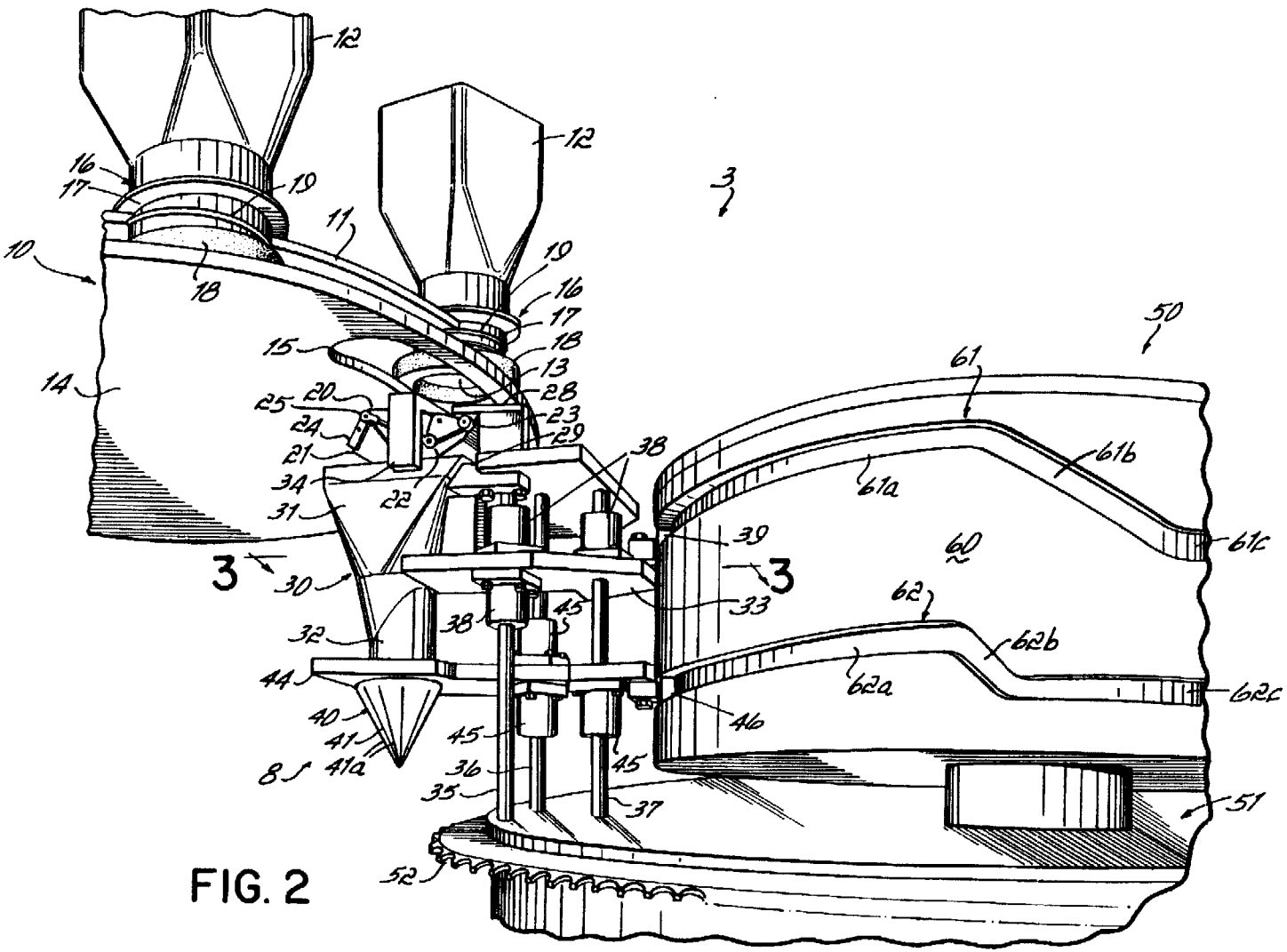
FIG. 2 is a perspective view in more detail of the apparatus of FIG. 1.

As best shown in FIG. 2, a hopper wheel assembly 10 is positioned above and adjacent to the filler wheel assembly 50. The hopper wheel assembly 10 includes a rotatable hopper wheel 11 having a plurality of hoppers 12 mounted on its top surface. A stationary plate 14 is rigidly mounted below the hopper wheel 11 and has an arcuate feed slot 15 for allowing product to pass from the discharge end 13 of each of the hoppers 12 into a product dispensing unit S moving in timed relation as the hoppers 12 rotate over the feed slot 15. The hoppers 12 receive a predetermined or measured amount of product from a product supply (not shown). The predetermined or measured amount of product corresponds to the amount of product needed to fill one pouch or a portion of the amount of product needed to fill one pouch. The product supply may take the form of a combinational scale system for feeding very accurately measured amounts of product into the hoppers, or may comprise other forms of product feeders. The measured amount of product is dropped into the top of the hopper 12 by the product supply system and falls to the lower discharge end 13 of the hopper 12. The lower discharge end 13 of each hopper 12 is closed off by the top surface of the stationary plate 14 when the hoppers 12 receive the measured amount of product.

Figure 3:
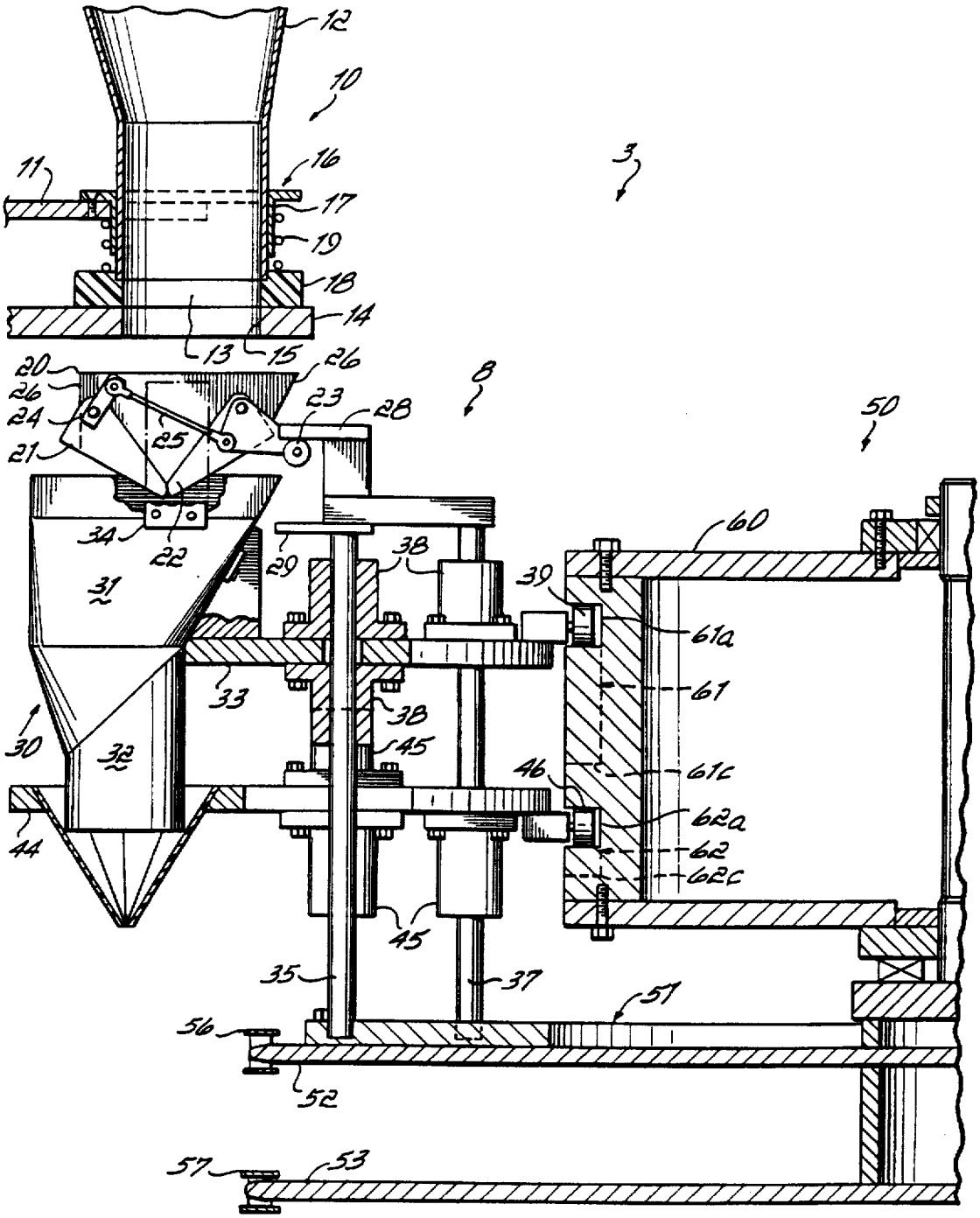
FIG. 3 is a cross-sectional view taken along line 3—3 of FIG. 2.

Turning to FIG. 3, each hopper 12 has a tubular hopper support 16 rigidly secured to the hopper wheel 11. Lower tubular portions of the hoppers 12 frictionally fit into the tubular supports 16 to attach the hoppers 12 to the hopper wheel 11. Each tubular support 16 has a lower tubular portion 17 extending below the hopper wheel 11. The lower tubular portion 17 of the hopper support 16 slidably receives a spring-loaded ring 18 attached at the lower end of the tubular portion 17 and resiliently urged against the top surface of the stationary plate 14 by means of a spring 19 positioned around the lower tubular portion 17. The spring-loaded ring 18 is preferably formed from a durable polymeric material such as Delrin® which acts as a bearing surface between the hoppers 12 and the stationary plate 14. Thus, as best shown in FIG. 3, the spring-loaded ring 18 slides along the stationary plate 14. When it reaches the arcuate slot 15, the predetermined or measured amount of product drops through the slot and into a registered product dispensing unit 8.

In FIG. 1 the hopper wheel assembly 10 is shown to rotate in a clock-wise direction while the filler wheel assembly 50 is shown to counter-rotate in a counter-clockwise manner. The hopper wheel assembly 10 rotates in timed relation to the filler wheel assembly 50 such that a product dispensing unit 8 is registered beneath the arcuate feed slot 15 at the transfer station 3 during the time at which a hopper 12 is passing over the feed slot 15. Product thus passes from the hopper 12 through the feed slot 15 and into the accumulation chamber 20 at the top of the product dispensing unit 8 at the product transfer station 3 during this time of registration. As noted above, other forms of product feeders can be used.

The Filler Wheel Assembly

As shown in FIGS. 2 and 3, the filler wheel assembly 50 includes a plurality of product dispensing units S rigidly secured to the outer periphery of the top surface of the rotatable filler wheel 51. The filler wheel assembly further includes a centrally mounted stationary cam drum 60 that does not rotate with the rotatable filler wheel 51. The rotatable filler wheel 51 is formed by an upper chain sprocket 52 and a lower chain sprocket 53 (FIG. 3). These sprockets rotate about a common axis and are driven by the pouch conveyor 2 which is defined in part by an upper chain 56 and a lower chain 57. The rotatable filler wheel 51 thus continuously rotates the product dispensing units 8 from the transfer station 3 where they pick up a predetermined or measured amount of product from a registered product hopper 12 to the filling station 4 (FIG. 1) where the product is then released into the individual pouches 2*a*. Once the pouches pass the filling station 4, the filler wheel continues to rotate the pouches past other hopper wheel assemblies 5, 6 and 7 where they may be further processed or filled. Thus additional assemblies may supply additional components to a partially filled pouch. The train of pouches 2*a* exit at a point 50*a*(FIG. 1) which is about 180° from the filling station 4 and travel on to the sealing and packaging stations further downstream.

The Product Dispensing Unit

As shown in FIGS. 2 and 3, a first embodiment of the product dispensing unit 8 includes an accumulation chamber 20 rigidly secured to the top of a product funnel assembly 30 by a bracket 34. The product funnel assembly 30 is positioned at the upper end of an expandable cone assembly 40. The product accumulation chamber 20 preferably includes upper walls 26 and two pivotally mounted, inclined bottom plates 21, 22 which form a dumper gate, which receive the product from the product hopper as the product hopper rotates over the arcuate slot 15 in the stationary plate 14. A linkage comprising links 24 and 25 operates the two plates 21, 22 to pivot into respective open and closed positions when the product dispensing unit is moved vertically into and out of the pouch. As the product dispensing unit 8 reaches its lowermost position, a lever 23 on the accumulation chamber 20 engages an actuating arm 29 causing the inclined plates 21, 22 to pivot to an open position and release the product into a pouch. An upper actuating arm 28 is likewise engaged by the lever when the product dispensing unit reaches its uppermost position to cause the inclined plates 21, 22 to pivot to a closed position and thus ready the accumulation chamber 20 for another measured amount of product.

Of course, it will be appreciated that other forms of accumulating devices could be used, such as those incorporating other gates or other valves, such as reciprocating, cone-shaped valves alternately closing and opening a valve seat, as will be described.

The accumulation chamber 20 receives a measured amount of product from the discharge opening 13 of a product hopper 12 as the hopper 12 passes over the arcuate slot 15 in the stationary plate 14. This measured amount of product is held in the accumulation chamber 20 until the filler wheel 51 rotates to the filling station 4 where the product is then released from the accumulation chamber 20 to allow the product to drop through the product funnel assembly 30 and the expanded cone 41 into a pouch 2*a* at the filling station 4.

The expandable cone 41 is preferably formed by a plurality of resilient or spring loaded fingers 41*a* screwed or otherwise secured to the cone support plate 44 at the open end of the cone 41. Resilient fingers are shown. The fingers 41*a* are preferably formed from a resilient polymeric material, however, thin metallic materials such as aluminum or other materials may also be utilized. Other manners of mounting the cone's sidewall portions in a resiliently pivotal fashion will be readily apparent to those of ordinary skill. It will be appreciated that the cone may be defined by a plurality of separate, independent fingers disposed together to form a cone when mounted, or by a single piece integral member having a plurality of distinct but integral fingers. Also, it has been contemplated to form the expandable cone with an integral sidewall having a plurality of folds that define distinct wall sections able to be expanded into an optimal circular configuration. Such an integrally formed cone would be advantageously manufactured from a polymeric material or paper product. Also, spring-loaded fingers could be used.

Of course, it will be appreciated that a circular pouch mouth opening is the preferred shape to receive bulky or randomly-shaped product such as potato chips, for example. Such items tend to get caught up when traversing other openings of non-circular configuration. This is particularly critical when the product size approaches that of the mouth opening. It will also be appreciated that the more fingers used in the cone, the pouch mouth can be formed closer to an actual circle.

The expandable cone assembly 40 and the product funnel assembly 30 are independently, vertically moveable along two outer support rods 35, 36 and one inner support rod 37, all of which are rigidly mounted to the top surface of the filler wheel 51. The funnel assembly 30 is rigidly connected to a funnel support plate 33 which has sliding bearings 38 that receive outer rod 35 and inner rod 37 to allow vertical sliding movement of the funnel assembly 30. The expandable cone assembly 40 includes a cone support plate 44 which has attached sliding bearings 45 that slidably receive outer rod 36 and the inner rod 37. An upper cam follower 39 is rigidly secured to the funnel support plate 33 on the end opposite to the funnel 31. A second lower cam follower 46 is rigidly secured to the end of the cone support plate 44 opposite the cone 41.

Figure 4:
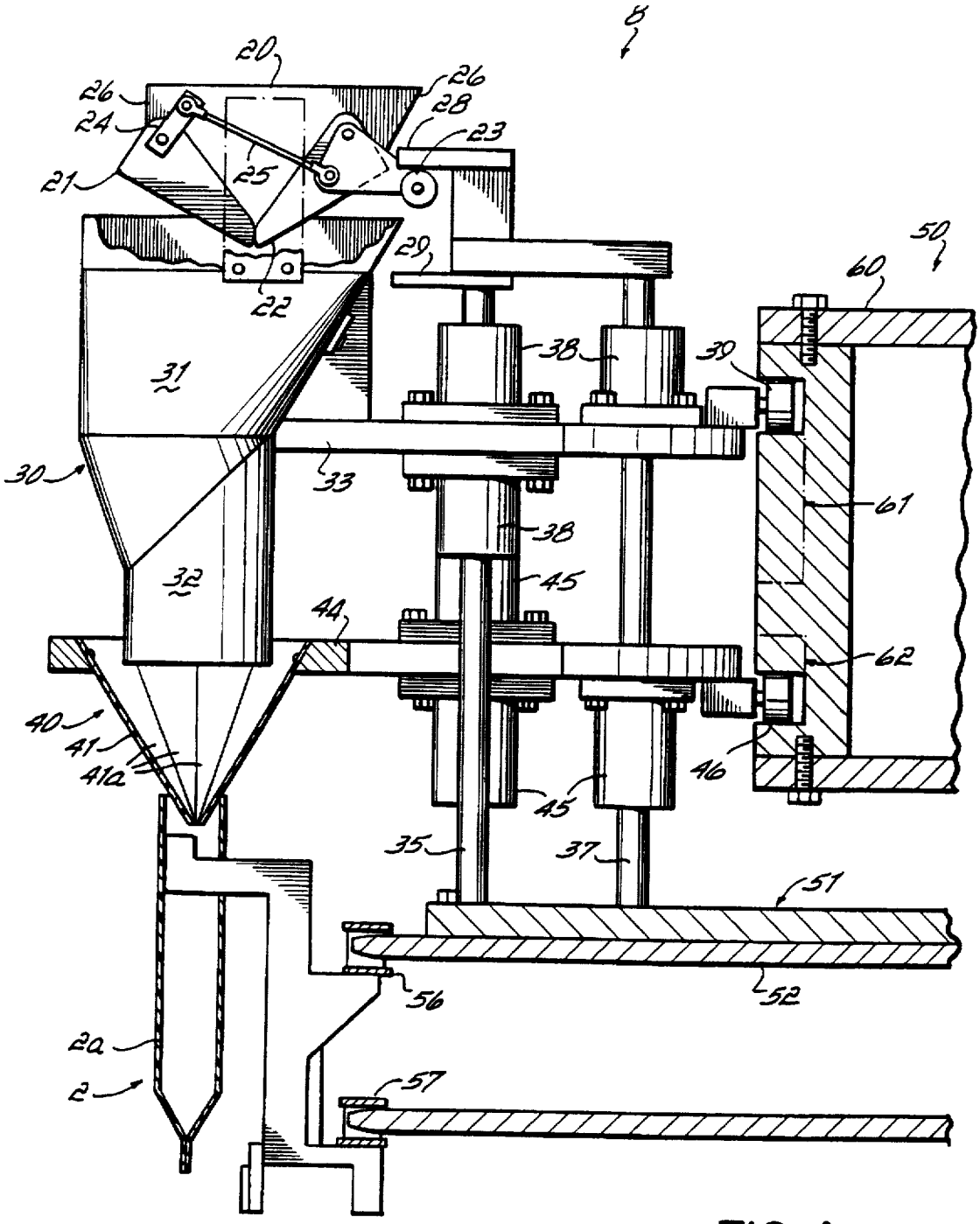
FIG. 4 is a cross-sectional view similar to FIG. 3 and showing the product dispensing unit of the invention with the filling cone in its initial inserted position.
Figure 6:
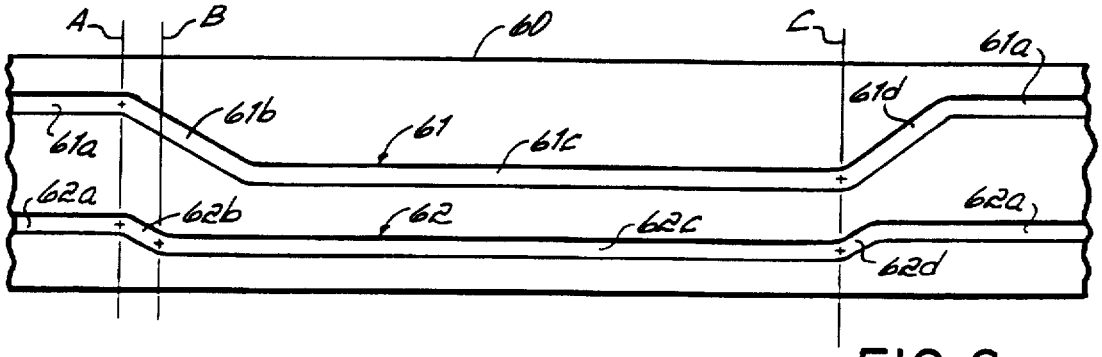
FIG. 6 is a developed view of the outer surface of the stationary cam drum of the invention laid out flat to show the orientation of the cam grooves.

Referring now to FIG. 4, as the filler wheel 51 rotates around to the filling station 4, the apex end 43 of the expandable cone 41 is initially lowered into an open pouch 2*a*. Here, the cone 41 is shown in its lowermost position inserted into a pouch 2*a* carried on the pouch conveyor 2. The cone 41 is caused to move downwardly into the pouch as the lower cam follower 46 enters the downwardly extending portion 62*b* of the lower cam groove 62 in the stationary drum or cylinder 60 (FIGS. 2 and 6). It should be noted that the cone assembly 40 moves downwardly with the upper funnel assembly 30 moving downwardly, and before the cone is expanded. If necessary, the upper funnel could move downwardly before the cone begins to move. However, it is important to insert the cone in its most contracted status to ensure consistent, non-interfering entry into a pouch. This allows the apex end 43 of the cone 41 to be inserted into the pouch 2*a* while the cone is in its most contracted configuration to ensure that the apex end 43 fits easily into the pouch 2*a* which has been biased into a partially open position by a gripper unit 9, which is part of conveyor 2 (FIG. 4).

Turning to FIG. 6, this feature of the invention is illustrated by the layout of the grooves 61, 62 on the outer surface of the stationary cylinder 60. Here it is seen that the downwardly extending portion 62*b* of the lower cam groove 62 begins to extend downwardly at the same angular position as the upper groove's downwardly extending portion 61*b* begins. See line A, showing the beginning of the lower each groove's downwardly extending portions 61*b* and 62*b*. Line B shows the completion of the lower groove's portion 62*b*. Thus, the contracted sidewall portions 41*a* of the cone 41 are caused to move down into the pouch 2*a* while the product funnel assembly 30 continues to rotate with the filler wheel 51 and begins to move downwardly at the same time, as defined by the upper horizontal portions 61*a* and 61*b* of the upper cam groove 61.

Figure 5:
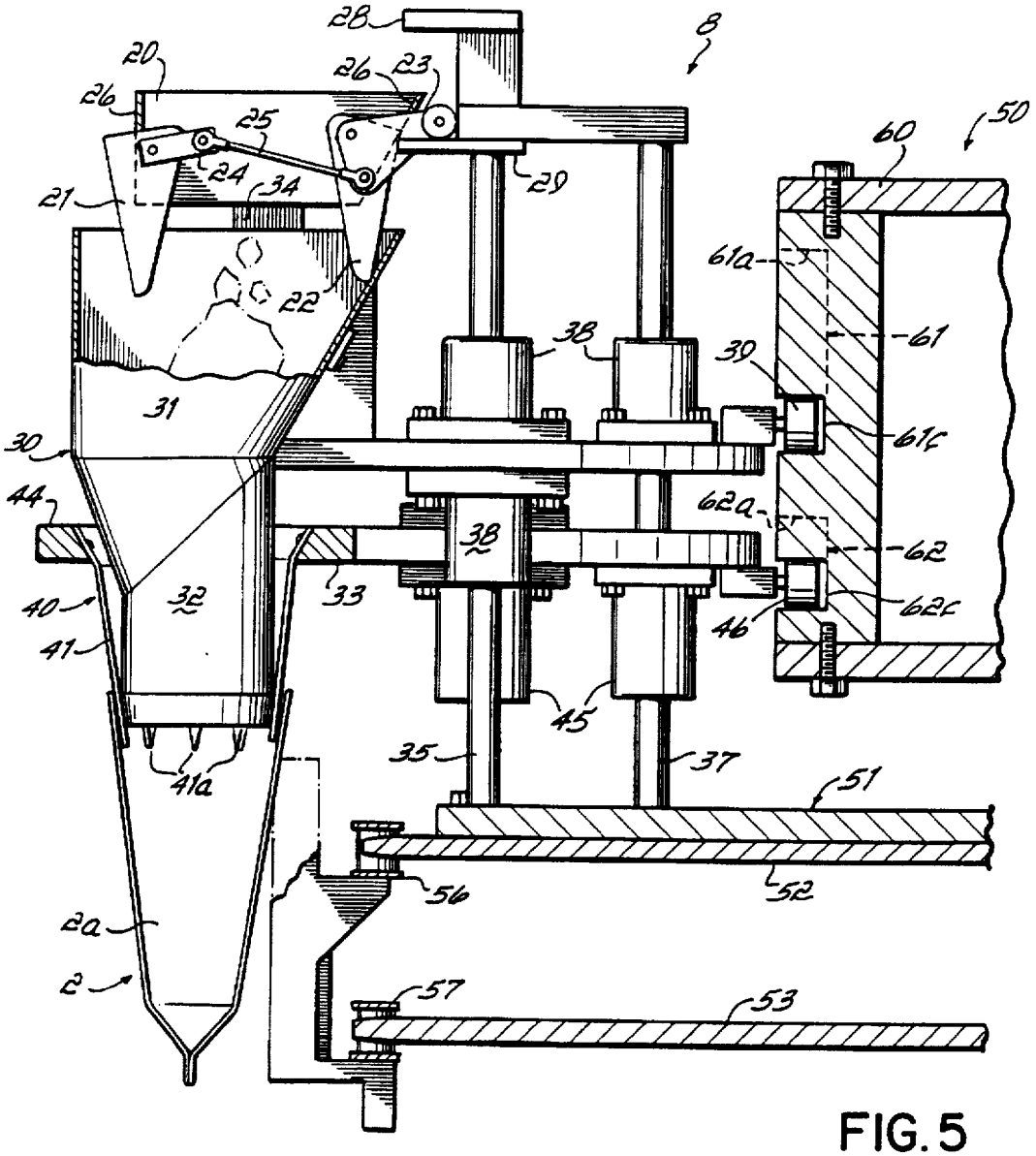
FIG. 5 is a cross-sectional view similar to FIG. 4 but showing the invention with the filling cone expanded.

Once the expandable cone assembly 40 has reached its lowermost position inside the pouch,(corresponding to cam groove 62). the product funnel assembly 30 continues to move downwardly, beyond angular position B, into the expandable cone 41 so that the lower cylindrical section 32 of the product funnel assembly 30 penetrates the cone 41 and expands the resilient fingers 41*a* into a circular configuration. FIG. 5 shows the product dispensing assembly 30 in its lowermost position after the upper cam follower 46 has travelled to the lowermost end of the downwardly extending portion 61*b* of the upper groove 61. In this position, the lower tubular portion 32 of the product funnel 31 is shown to have fully expanded the expandable cone 41 to create an optimal cylindrical opening in the top portion of the pouch 2*a*. While the lower tubular portion 32 of the product funnel 31 is being lowered into the cone 41, the lever arm 23 of the accumulation chamber 20 engages the lower lever actuating arm 29 to pivot the bottom plates 21, 22 into an open position and thus drop the predetermined amount of product from the accumulation chamber 20 through the funnel 31 and into the expanded pouch 2*a*, or to activate any alternative gating or valving means.

After the product has been dispensed into the expanded pouch, the accumulation chamber 20, product funnel assembly 30, and cone assembly 40 are raised to their start-up positions. This motion may begin at angular position C (FIG. 6) which may preferably be located in the arcuate area R (FIG. 1) where the pouches begin to depart from the filler wheel 50.

The separate upward movements of the accumulation chamber 20, product funnel assembly 30, and expandable cone assembly 40 are caused by upwardly extending portions 61*d*, 62*d* of the upper and lower grooves 61, 62, respectively, in the outer surface of the cam drum or cylinder 60. The two upwardly extending portions 61*d*, 62*d* of the upper and lower grooves 61, 62 begin to extend upwardly at the same circumferential location on the outside surface of the drum 60. This relationship is shown by vertical line C drawn through the points at which the upwardly extending portions 61*d*, 62*d* begin. Thus, the funnel assembly 30 and cone assembly 40 are raised together initially so that the cone 41 is initially raised with its resilient fingers 41*a* in an expanded condition. This prevents the cone from picking up product on its way out of the pouch 2*a* This would likely occur if the lower tubular portion 32 of the funnel 31 were to be extracted from the cone 41 before the resilient fingers 41*a* were out of the pouch 2*a* That is, if the lower portion 32 of the funnel 31 was raised out of the expanded cone 41, the resilient sidewall portions or fingers 41*a* would start to contract and pick up product while the apex end 43 of the cone 41 was still in the pouch.

NON-EXPANDABLE CONE

Figure 7:
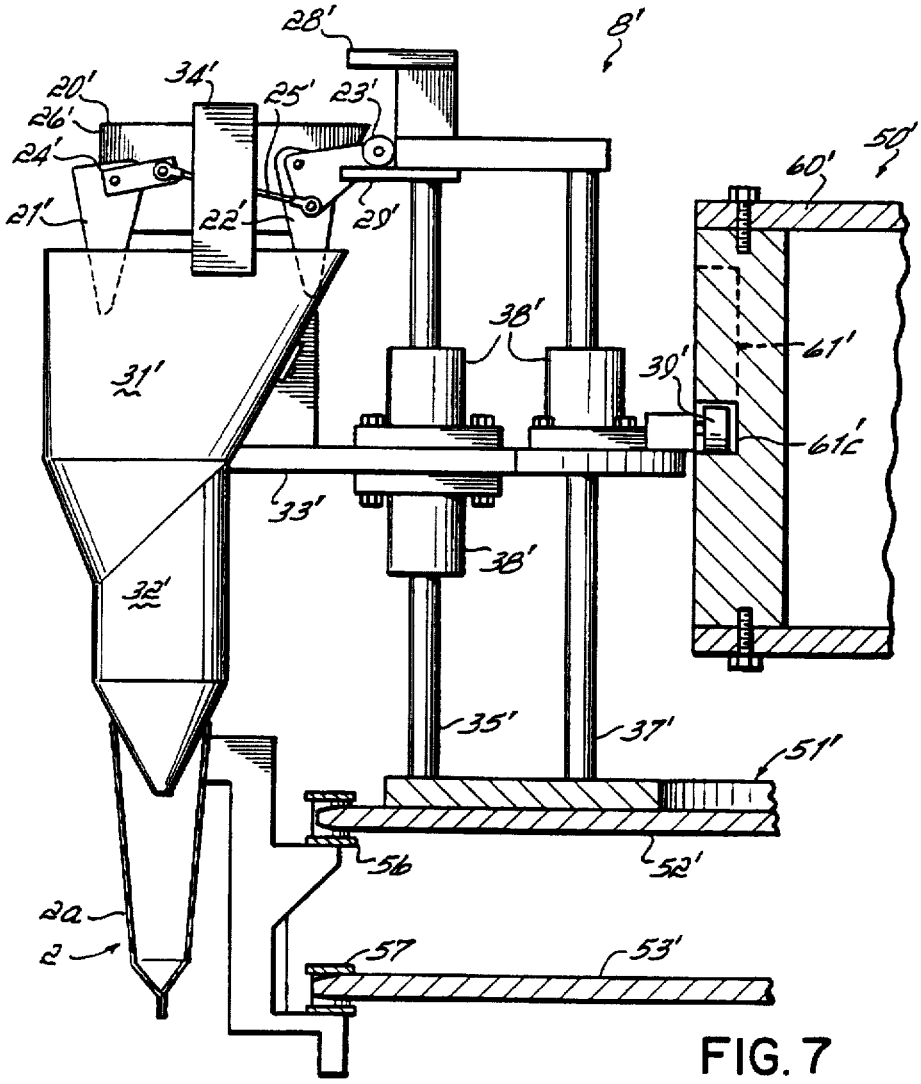
FIG. 7 is a cross-sectional view similar to FIG. 5 but showing another embodiment of the product dispensing unit of the invention having a non-expansible cone.
Figure 8:
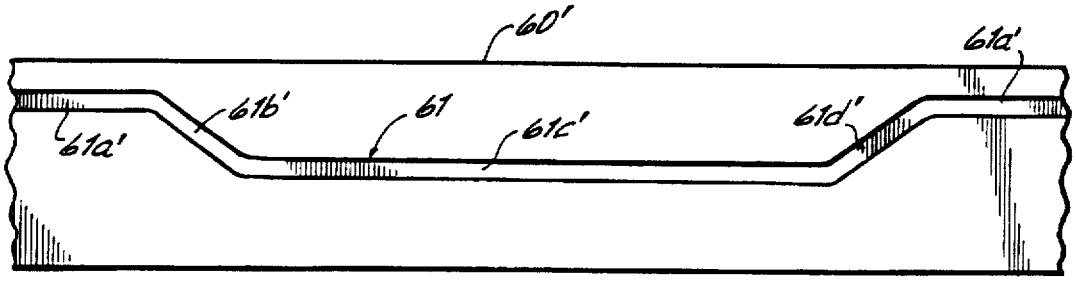
FIG. 8 is a developed view of the outer surface of the stationary cam drum used in the embodiment of FIG. 7 and laid out flat to show the orientation of the cam groove.

A second embodiment of the product dispensing unit 8 is shown in FIG. 7. In this embodiment, the expandable cone assembly 40 has been eliminated and the product funnel 31' has a lower generally conical discharge end 32' that is generally cone shaped and may easily be inserted into an open pouch top. This embodiment would be especially useful for small amounts of fine, granular product which would flow easily through the funnel 31' and into the pouch 2*a* without the need for expanding the pouch 2*a* It will be appreciated that the bottom groove 62 in the cylinder or drum 60 has been eliminated along with the cone assembly 40. In addition, only two vertical rods 35', 37' and one set of sliding bearings 38' are necessary to slidably support the funnel assembly 30'. The groove 61' in the stationary cylinder 60' remains essentially of the same design as the top groove 61 in the first embodiment.

During the rotation of the filler wheel 51' from the product transfer station 3 to the filling station 4, the cam follower 39' will reach the downwardly extending portion 61*b'* of the cam groove and the lower end 32' of the funnel 31' will begin to descend into the open pouch top. When the lower discharge end 32' of the product funnel 31' is inserted in the pouch 2*a*, the lever arm 23' of the accumulation chamber 20' engages the lower lever actuating arm 29' and causes the bottom plates 21', 22' of the accumulation chamber 20' to pivot to their open position, dropping the product through the funnel 31' and into the pouch 2*a*.

After the product has been dispensed into the pouch 2*a*, the cam follower 39' continues to follow the lower portion 61*c'* of the cam groove 61' until it hits the upwardly extending portion 61*d'*, thus raising the lower end 32' of the product funnel 31' out of the pouch 2*a*. When the product dispensing unit 8' reaches the upper horizontal portion 61*a'* of the cam groove 61', the accumulation chamber 20' is ready to receive another measured amount of product.

ALTERNATE PRODUCT DISPENSER

Figure 9A:
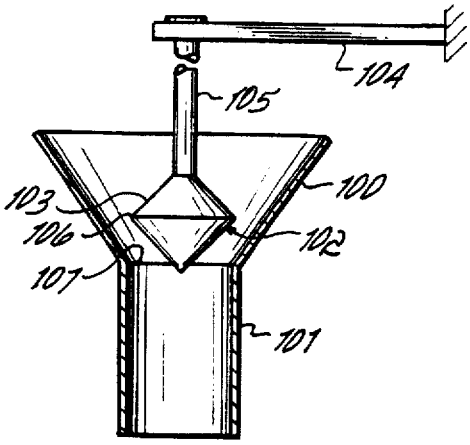
Figure 9B:
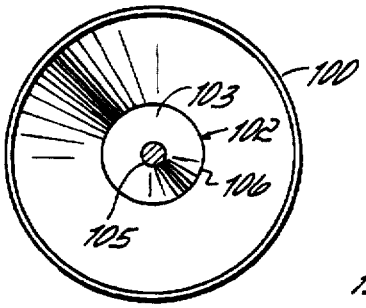

FIGS. 9, 9*a* and 9*b* illustrate an alternative embodiment of accumulation chamber 20. A funnel 100 serves as the accumulation chamber and is connected to, or integral with, spout 101 which operates like spout 32 (FIGS. 3, 4 and 5). A valve or gate in the form of cone-shaped plug 102 extends downwardly into funnel 100, being mounted on a stationary support 104 by rod 105. Support 104 is connected or mounted on a filler wheel apparatus 52 (such as in FIGS. 1–5). Plug 102 has an upper surface 103 and an outer periphery 106 which seats on circular juncture or seat 107, formed at the joining of funnel 100 and spout 101, sealing off passage from funnel 100 to spout 101 (FIG. 9).

When the funnel 100 and spout 101 are lowered, as described above in connection with the description of the accumulation chamber of FIGS. 2–7, spout 101 is moved downwardly into any associated pouch filling apparatus such as a cone 41 (not shown in FIGS. 9–9b). Spout 101 expands the cone to expand the pouch thereunder.

This same motion separates juncture 107 from the outer periphery 106 of plug 102. This opens funnel 100 so product deposited therein (such as from hoppers 12 on wheel 10) can flow into spout 101 and an underlying pouch.

This action also "streams" the product as the funnel moves downwardly, resulting in a relative upward motion of plug 102. This tends to "lift" product away from the eventual opening between plug 102 and juncture or seat 107, thus facilitating product flow into spout 101.

ALTERNATIVE POUCH EXPANDER

FIGS. 10–13 illustrate an alternative pouch expander for use where rectilinear, as opposed to circular, pouch openings are required. For example, it may be desirable to fill a rectangular-shaped bag, and to shape it into its final form for filling in its final configuration.

In this regard, an alterative pouch expander 120 comprises a plurality of side fingers 121 which, as shown, are formed by slits such as at 122, 123. Fingers 121 are formed from an integrally-formed member of resilient material as shown, or can be separately pivoted or gauged and spring-loaded.

Expander 120 has also end fingers 124, 125 and 126, 127. The bottom edges or ends of fingers 121 and 124–127 are oriented in an aligned configuration to define, in essence, line or lower expander edge 130 to facilitate entry into a pouch or bag.

As diagrammatically illustrated in FIGS. 8, 10, 12 and 13, a spout 132, akin to spout 32 or spout 101 in the prior embodiments, is used to descend into expander 120 to force open fingers 121 and 124–127, after they are inserted into a pouch, to expand the pouch mouth into a rectangular opening for filling. Spout 132 is preferably of a rectangular configuration as shown in order to open the expander 120.

Other configurations of expanders could also be used as desired. Two, three, four or more fingers of various desired configuration can be provided as desired.

Operation

As shown in FIG. 2, the product dispensing unit 8 will rotate with the filler wheel 51 and the upper cam follower 39 and lower cam follower 46 will ride in the upper groove 61 and lower groove 62, respectively, of the stationary drum or cylinder 60. Thus, the funnel assembly 30 will move vertically along the rods 35, 37 as the upper cam follower 39 moves up and down according to the path of the cam groove 61 in the stationary drum or cylinder 60. Likewise, the cone assembly 40 will independently move vertically along the rods 36, 37 according to the vertical movement of the cam follower 46 in the lower groove 62 of the stationary drum or cylinder 60.

As is more clearly shown in FIG. 3, the product is discharged from the discharge end 13 of the product hopper 12 through the arcuate slot 15 and into the product accumulation assembly 20. This transfer occurs at the product transfer station 3 as previously described in connection with FIG. 1. In FIG. 3 the product dispensing unit 8 is shown in its uppermost position with the upper cam follower 39 riding in the uppermost horizontal section **61*a* of the upper groove 61 and the lower cam follower 46 riding in the uppermost horizontal section 62*a* of the upper cam groove 62. In this upper position, the bottom inclined plates 21, 22 of the product accumulation chamber 20 are pivoted to a closed position through contact of the lever arm 23 with the upper lever actuating arm 28. Engagement of the lever arm 23 with the upper lever actuating arm 28 causes the linkage assembly to force the bottom plates 21, 22 together thus holding the product in the accumulation chamber 20**.

As the filler wheel continues to rotate from the product transfer station 3 to the filling station 4, the apex end 43 of the cone 41 is inserted into a partially open pouch **2*a* as the lower cam follower 46 reaches the end of the downwardly extending portion 62*b* of the lower groove 62 (see FIG. 4). Immediately thereafter, the product funnel assembly 30 and attached accumulation chamber 20 reach their lowermost position, i.e. the upper cam follower 39 reaches the end of the downwardly extending portion 61*b* of the upper groove 61. At this point, the lower discharge end 32 has been lowered into the cone 41 and has thus expanded the resilient fingers 41*a* and the pouch 2*a* (see FIG. 5). Simultaneously, the lever arm 23 engages the lower lever actuating arm 29 and pivots the bottom inclined plates 21, 22 of the product accumulation chamber 20 into an open position. Preferably, this occurs after 90° of rotation between the product transfer station 3 and the filling station 4**.

After the product has been released from the accumulation chamber 20 through the funnel 31 and the expanded cone 41 and into the pouch **2*a*, the product funnel assembly 30 and attached accumulation chamber 20 are raised to their initial position as the filler wheel 51 continues to rotate past hopper assemblies 5, 6, and 7, shown in FIG. 1. Alternately, the funnel assembly 30 and accumulation chamber 20 are raised after passing assemblies 5, 6 and 7, as desired. The bottom plates 21, 22 of the accumulation chamber 20 will then close and the accumulation chamber 20 will then be ready to receive another measured amount of product from the product hoppers 12 at the product transfer station 3**.

In the second embodiment, the product dispensing unit 8' operates in much the same way as the product dispensing unit 8 of the first embodiment. Referring to FIG. 1 in conjunction with FIGS. 7 and 8, it will be appreciated that as the product dispensing unit 8' rotates with the filler wheel 51' from the product transfer station 3 to the filling station 4, the cam follower 39' will ride along the upper horizontal portion **61*a*' of the cam groove 61' in the stationary cylinder 60' until it reaches the downwardly extending portion 61*b*' where it will begin its descent and thus begin to insert the lower portion 32' of the product funnel 31' into the pouch 2*a*. As the cam follower 39' reaches the end of the downwardly extending groove portion 61*b*', the lever arm 23' of the accumulation chamber 20' hits the lever actuating arm 29' and causes the bottom plates 21', 22' to pivot to an open position and drop the product through the funnel 31' and into pouch 2*a***.

The filler wheel 51' continues to rotate after the filling operation is complete and the product dispensing unit 8' is raised to its start-up position as the cam follower 39' rides along the upwardly extending portion **61*d*' of the cam groove 61'. As the product dispensing unit 8' is raised, the lever arm 23' hits the upper lever actuating arm 28' thus pivoting the bottom plates 21', 22'** into their closed position to await the next transfer of a measured amount of product at the product transfer station 3.

Accordingly, the invention provides higher pouch filling speeds, more efficient use of the space surrounding the periphery of the filler wheel and optimum expansion of pouches at the filling station to provide quicker flow of product into a pouch.

Of course, it will be appreciated that if hopper assemblies 5, 6 and 7 are used operatively to process or fill pouches 2*a* on filler wheel assembly 50, then cam grooves 61, 62 in cam drum 60 may be oriented to time the movement of the respective components of the product dispensing units 8 operating therewith.

Alternative Embodiment

In an alternative embodiment, the product dispensing unit can be simplified by eliminating the pouch expansion assembly for those pouch filling operations in which pouch expansion is not necessary. This embodiment not only simplifies the apparatus, but still allows more efficient use of the space surrounding the filler wheel assembly and thus allows the introduction of further pouch filling and/or processing stations in the space surrounding the filler wheel assembly.

Alternative Embodiment

FIGS. 14–16 illustrate an alternative embodiment of the invention. In this embodiment, the product is dumped directly from the hopper wheel into a plurality of cups or chambers rotating with a spout wheel in a plane intersecting that of the pouch filler wheel. When spouts and cups rotate and the spouts descend into pouches, product is released from the cups into the spouts and registered pouches through an arcuate discharge slot in a snake plate beneath the cups and above the spouts. The cups and spouts are not raised and lowered vertically other than by virtue of their rotation in a tilted plane with respect to the plane in which the pouches move.

Turning now particularly to the details shown in FIGS. 14–16, like numbers are used to refer to parts similar to those in FIGS. 1–13.

In FIG. 14, a pouch train 2*a* is wrapped about a filler wheel assembly 200 including (see FIG. 15) a hub 201, a cup wheel 202, a spout wheel 203 and a pouch wheel 204 shown in phantom for positional reference only, all rotationally mounted on a frame 199.

Pouch wheel 204 is of any suitable type having grippers or other means well known in the art for gripping a plurality of pouches 2*a* such as pouches 2*b* and 2*c* and carrying them around filler wheel assembly 200 at a predetermined number or pitch.

Hub 201, cup wheel 202 and spout wheel 203 rotate in a first plane about centerline CL-1 while pouch wheel 204 rotates in another plane about centerline CL-2. The centerlines intersect, i.e. are not parallel so that cupwheel 202 and spout wheel 203 rotate in a plane at an angle to the plane of rotation of pouch wheel 204. Thus, as the wheels turn, the planes converge, and spouts 205 spaced about spout wheel 203, are raised from and lowered into pouches 2*a* in a well known manner.

Centerline CL-2 is preferably vertical. Thus, in FIGS. 15, spout 205*a* is raised from pouch 2*b*, and spout 205*b* is inserted in pouch 2*c* all by virtue of the inclined planes of rotation.

A snake plate 206 is mounted on frame 199 beneath cup wheel 202 and does not rotate with it but is fixed. The bottoms 207, 208 of cups 209, 210 respectively, are of suitable bearing material and telescope over the cups. Springs 211 urge the cup bottoms 207, 208 into sliding engagement with snake plate 206.

Snake plate 206 has an arcuate slot 214, as shown in FIG. 16, residing in a sector S of the plate. As the cups 209, 210, etc. rotate over the slot 214, product in the cups drops through the snake plate 206 into the spout thereunder and into a registered pouch below. Thus product in cup 210 (FIG. 15) drops through slot 214 and spout 205*b* into pouch 2*c*. At the same time, cup 209 is sealed off by snake plate 206 so product filled or filling therein does not drop into spouts 205*a* or pouch 2*b*.

It will, of course, be appreciated that a plurality of cups and spouts are provided, one spout rotating in register with each cup. The cups have funnel-like tops 212, 213 for receiving product as will be described.

At least one hopper wheel assembly 10 like that shown in FIGS. 1–3 is provided. A tubular hopper support 16 is secured to hopper wheel 11 for mounting lower tubular portions of hoppers 12 on wheel 11. A springloaded ring 18 is biased by spring 19 against non-rotating snake plate 14; and is telescoped about the lower end of hopper 12. When hopper 12 is rotated over arcuate slot 15 in plate 14, product is dropped from hopper 12 through slot 15 into a funnel top 212 of cup 209, for example.

Of course, a predetermined material or product is metered by any suitable scale or dispensing means into hoppers 12, a plurality of which are mounted on wheel 11. In one embodiment, for example, wheel 11 may carry one-half as many hoppers 12 as there are cups mounted on cup wheel 202. Thus, with a cup at every pitch, corresponding to a pouch spacing, there may be a hopper for every other pitch. Hoppers 12 can be provided in any predetermined ratio to cup pitch.

It will also be appreciated from FIG. 14 that a plurality of feed assemblies such as assembly 10, may be positioned about filler wheel apparatus 200, such as on axes B, C and D, for example, to provide for filling the cups and registered pouches. These are located proximate the periphery of the filler wheel with a portion of the circular path traversed by the hoppers overlying a portion of the circular path traversed by the cups.

Also, it will be appreciated that all feed assemblies 5, 6, 7 and 10 are disposed over a sector of filler wheel assembly 200 which is spaced from that sector S (FIG. 14) containing arcuate slot 214 in snake plate 206. Thus, cup filling preferably takes place at times when the cup bottoms are sealed on plate 206, and/or while over the slot 214. Product is not dumped from the cups until an associated spout is introduced into a registered pouch moving about filler wheel assembly 200 in sector S where cups are filled through slot 214.

Accordingly, one or a plurality of various feed assemblies counter rotating with filler wheel assembly 200 fill the cups which are then dumped into the pouches to load each pouch with a pre-determined product fill.

This embodiment has the advantage of the use of multiple feeding assemblies for filling cups of product, not adversely affected by sliding over a snake plate 206, and without more complex reciprocating mechanisms for accumulators or pouch dilating spouts. Pouches can be filled seriatim with fewer hoppers than there are pouch pitches, or varied, multiple component products can be filled into each pouch, all by virtue of the selectable ratio of hoppers to pouch or cup pitch, or by virtue of that and/or the number of feeding assemblies used at the filler wheel.

Alternative Embodiment

In yet another alternative embodiment, as also illustrated by FIG. 14, it may be perferable to provide filler assemblies such as hopper wheels 10 on axes C and D only (FIG. 14)

and not on axes A or B. Such a configuration may be preferable, due for example, to the number of components to be loaded and/or to the speeds desired.

In such a configuration, snake plate 206 could be eliminated, the product falling directly into the pouches. The feeders or hopper wheels 10 would fit over the area of the filler wheel with opened pouches thereon, so that product falls through the cups or chambers directly into the open pouches. In other words, without snake plate 206, the hoppers 110 would drop product through the open accumulation chambers or cups directly into open pouches in register therebeneath such as those about filler wheel 200 at axes C and D.

These and other objectives and modifications will become readily apparent to one of ordinary skill in the art without departing from the scope of the invention, and applicant intends to be bound only by the claims appended hereto.

We claim:

1. Apparatus for dispensing product into pouches and comprising:

a horizontally mounted, rotatable filler wheel mounted for rotation about a first axis;

means on said wheel for moving pouches through a path along a periphery portion of said filler wheel;

a product supply apparatus mounted for rotation about a second axis spaced from said first axis add having a periphery operably overlying a segment of the periphery portion of said filler wheel;

at least one product dispenser mounted on and rotating with said filler wheel for receiving product as it is dropped from said product supply means in said segment; and, said product dispenser including a product accumulation means for receiving product from a product supply station, holding product, transporting product to a product filling station, and dropping said product into registered pouches at said filling station.

2. The apparatus of claim 1 wherein said product accumulation means further comprises:

an accumulation chamber operatively positioned at an upper end of said product dispenser and having gate means for holding said product, and means for opening said gate means at a filling station to drop said product into a registered pouch.

3. The apparatus of claim 1 wherein said product supply apparatus further comprising:

a rotatable hopper wheel carrying at least one product hopper;

a stationary product release plate mounted below said rotatable hopper wheel and having an arcuate feed slot for passing product dropped from said hopper as said hopper rotates over said feed slot;

said rotatable filler wheel being horizontally mounted adjacent and below said product release plate; and, means for rotating said filler wheel and said hopper wheel in timed relation whereby product is dropped from said product hopper through said feed slot and into a registered product dispenser as said hopper wheel and filler wheel rotate.

4. The apparatus of claim 3 further including a discharge funnel having an upper product receiving end and a lower product discharge end, said product receiving end disposed to receive product from said product accumulation means and said product discharge end disposed to drop product into a registered pouch.

5. Apparatus for dispensing product into pouches and comprising:

a horizontally mounted, rotatable filler wheel;

means for moving pouches about a portion of said filler wheel;

at least one product dispenser mounted on and rotating with said filler wheel for receiving product as it is dropped from a product supply means;

said product dispenser including a product accumulation means for receiving product from a product supply station, holding product, transporting product to a product filling station, and dropping said product into registered pouches at said filling station;

a rotatable hopper wheel carrying at least one product hopper;

a stationary product release plate mounted below said rotatable hopper wheel and having an arcuate feed slot for passing product dropped from said hopper as said hopper rotates over said feed slot;

said rotatable filler wheel being horizontally mounted adjacent and below said product release plate;

means for rotating said filler wheel and said hopper wheel in timed relation whereby product is dropped from said product hopper through said feed slot and into a registered product dispenser as said hopper wheel and filler wheel rotate;

a discharge funnel having an upper product receiving end and a lower product discharge end, said product receiving end disposed to receive product from said product accumulation means and said product discharge end disposed to drop product into a registered pouch; and further including an expandable cone means mounted below said product discharge end of said discharge funnel, said cone means having an upper product receiving end and a lower product discharge end for insertion into a pouch, said discharge end of said funnel being moveable into said cone means and for thereby expanding said cone means to expand the mouth of a pouch.

6. The apparatus of claim 5 further comprising:

means for moving said expandable cone means downwardly to insert said cone discharge end into a pouch mouth; and means for moving said funnel discharge end into said cone means for expanding said cone after said cone discharge end has been inserted into said registered pouch to expand said pouch for product filling.

7. The apparatus of claim 6 further comprising means for moving said product discharge end of said funnel downwardly into said expandable cone after said cone discharge end has been inserted into said open pouch.

8. The apparatus of claim 7 wherein said means for moving both said expandable cone and said discharge funnel downwardly further comprises:

a stationary cylinder mounted over said filler wheel;

said cylinder having vertically spaced upper and lower circumferential cam grooves in an outer wall of said cylinder;

said upper and lower grooves each having upper and lower horizontally extending portions, a downwardly angled portion and an upwardly angled portion;

said downwardly angled portion of said upper groove being longer than said downwardly extending portion of said lower groove, a first cam follower attached to said discharge funnel, a second cam follower attached to said expandable cone means, said first cam follower being disposed in said upper circumferential groove and said second cam follower operably disposed in said lower circumferential groove;

said funnel and cone means respectively moving upwardly and downwardly in response to travel of said followers in said grooves as said filler wheel rotates;

said longer downwardly angled portion of said upper groove generating downward movement of said discharge funnel with respect to said expandable cone thereby expanding said expandable cone by forcing said discharge end of said funnel into said expandable cone.

9. The apparatus of claim 8 wherein said product accumulation means includes an accumulation chamber having a bottom gate which is operable to drop product into a pouch, and further including means for opening said bottom gate including:

a pivoting lever arm means operatively connected to said gates; and a first lever actuating arm rigidly secured to said product dispenser in a position to engage said pivoting lever arm when said first cam follower reaches the end of said downwardly angled portion of said top groove.

10. The apparatus of claim 9 wherein said upwardly extending portions of said upper and lower groove are in register to raise said expandable cone in an expanded condition to prevent picking product up as said expandable cone and discharge funnel are raised out of a pouch.

11. The apparatus of claim 10 wherein said upper groove upwardly extending portion is longer than said lower groove upwardly extending portion to return said discharge funnel to a start-up level at which to receive product from a product hopper.

12. The apparatus of claim 11 further comprising:

lever actuating means for closing said accumulation chamber bottom gate when said discharge funnel reaches its start-up level.

13. The apparatus of claim 12 wherein said lever actuating means further comprises:

a second lever actuating arm, disposed on said dispenser, said pivoting lever arm engaging said second lever actuating arm when said first cam follower reaches the top of said upwardly extending portion of said upper groove.

14. The apparatus of claim 13 further including:

a plurality of rods secured to and extending upwardly from said filler wheel;

a discharge funnel support plate having first and second ends and being slidably mounted to at least two of said plurality of rods, said discharge funnel being secured to said funnel support plate first end and said first cam follower being secured to said funnel support plate second end; and a cone support plate having first and second ends and being slidably mounted to at least two of said plurality of rods, said expandable cone being secured to said cone support plate first end and said second cam follower being secured to said cone support plate second end.

15. Apparatus for expanding an open mouth of a pouch for filling said pouch with product and comprising:

a filler tube;

expandable cone means having a central axis, an open end, an opposed apex end, and an expandable wall extending between said open end and said apex end and formed by at least three distinct, movable wall sections;

means for inserting at least said apex end of said cone into an open end of a pouch; and, means for inserting and withdrawing said filler tube into said cone means for expanding and contracting said distinct, movable wall sections radially with respect to said central axis at a location proximate to said apex end while said apex end is inserted in said pouch open end for filling said pouch upon said expansion.

16. The apparatus of claim 15 wherein said distinct, movable wall sections further comprise at least three fingers secured at said open end of said cone means and being radially movable with respect to said central axis between expanded and contracted positions at said apex end.

17. The apparatus of claim 15 wherein said wall sections are integrally formed together into a one-piece unit.

18. Apparatus for expanding an open mouth of a pouch for filling said pouch with product and comprising:

expandable cone means having a central axis, an open end, an opposed apex end, and an expandable wall extending between said open end and said apex end and formed by at least three distinct, movable wall sections;

means for inserting at least said apex end of said cone into an open end of a pouch;

means for expanding and contracting said distinct, movable wall sections radially with respect to said central axis at a location proximate to said apex end while said apex end is inserted in said pouch open end; and wherein said means for expanding and contracting said distinct, movable sections comprises a product funnel having an annular discharge end and mounted for movement toward and away from said sections to expand and contract said wall sections.

19. The apparatus of claim 18 wherein said means for inserting said cone into a pouch further comprises:

a first cam surface having a downwardly extending portion located adjacent to a pouch filling station;

a first cam follower connected to said cone and operatively engaged said first cam surface; and means for moving said first cam follower along said first cam surface to cause downward movement of said cone into said pouch open end at a pouch filling station.

20. The apparatus of claim 19 wherein said means for expanding and contracting said wall section further comprises:

a second cam surface located above said first cam surface and having a downwardly extending portion located adjacent said pouch filling station, said second cam surface downwardly extending portion being longer than said first cam surface downwardly extending portion;

a second cam follower connected to said product funnel and operatively engaged with said second cam surface; and means for moving said second cam follower along said second cam surface to cause downward movement of said product funnel into said expandable cone.

21. The apparatus of claim 20 further comprising:

an upwardly extending portion in each of said first cam surface and said second cam surface, said upwardly extending portions having initial portions in register, and said second cam surface upwardly extending portion being longer than said first cam surface upwardly extending portion whereby said product funnel is moved away from said cone means after said cone means is withdrawn from a pouch mouth.

22. Apparatus for expanding the mouth of a pouch into a substantially circular shape for filling with product and comprising:

an expansible cone means, a product spout;

means for inserting said cone means into a pouch; and means for inserting said spout into said cone means for expanding said cone means and said pouch mouth in a substantially circular shape.

23. The apparatus of claim 22 wherein said lower end portion of said spout is cylindrically shaped.

24. The apparatus of claim 23 wherein said expansible cone means further comprises:

a plurality of sidewall portions resiliently inwardly biased at said lower portion of said cone means.

25. The apparatus of claim 24 wherein said sidewall portions further comprise at least three fingers biased into a contracted conical configuration.

26. Apparatus for dispensing particulate product into moving pouches and comprising:

a moving dispenser having an upper end for receiving said product and a lower end for discharging said product, into moving pouches, said moving dispenser mounted for rotation about a first axis;

said upper end having accumulation means for receiving a predetermined amount of said product, holding said predetermined amount, and dropping said predetermined amount into a pouch at a predetermined later time through said lower end of said dispenser, and further including hopper apparatus mounted for rotation about a second axis spaced from the first and in a counter direction to the notation of said moving dispenser, said hopper apparatus and said moving dispenser each defining peripheral paths, a portion of one disposed over a portion of the other, in operative disposition for transfer of particulate product from the hopper apparatus to the moving dispenser.

27. The apparatus of claim 26 further comprising:

carrying means for moving said dispenser from a product receiving station where said predetermined amount of said product is transferred into said accumulation means to a pouch filling station where said predetermined amount of said product is dropped into a registered pouch.

28. The apparatus of claim 27 wherein said carrying means comprises:

a horizontally mounted rotatable filler wheel, said dispenser being mounted on the top surface of said filler wheel and rotating with said filler wheel to travel from said product receiving station to said pouch filling station.

29. Apparatus for dispensing particulate product into moving pouches and comprising:

a moving dispenser having an upper end for receiving said product and a lower end for discharging said product, said upper end having accumulation means for receiving a predetermined amount of said product, holding said predetermined amount, and dropping said predetermined amount into a pouch at a predetermined later time through said lower end of said dispenser; and wherein said accumulation means comprises an accumulation chamber having side walls, an open top, and pivotally mounted bottom gate means for holding product at the upper end of said dispenser and for opening and closing said accumulation chamber, and means for pivoting said gate means into open and closed positions.

30. Apparatus for expanding the mouth of a pouch for filling the pouch with product and comprising:

a pouch expansion means including a plurality of opposed fingers having lower ends biased toward one another for insertion into a pouch wherein top ends of opposed fingers are disposed apart and forming an inlet to said pouch expansion means, a product spout having a lower end, means for inserting said pouch expansion means at least partially into a pouch, such that lower ends of said fingers are disposed in a pouch, and means for inserting said spout into said expansion means for engaging said fingers and for moving and expanding lower ends thereof apart to expand the mouth of a pouch into a predetermined shape which is a function of the lower ends of said fingers when expanded.

31. Apparatus as in claim 30 wherein said fingers are in the shape of a cone prior to expansion by a spout.

32. Apparatus as in claim 30 wherein said expansion means fingers when expanded define a rectangular configuration.

33. Apparatus as in claim 32 wherein said expansion means comprises a plurality of fingers in two opposed side banks of fingers and another plurality of fingers in two opposed end banks of fingers, said fingers in said end banks being tapered, and lower ends of said fingers in said side banks and said end banks defining a line, when not expanded, for insertion into a pouch.

34. Apparatus as in claim 33 wherein said expansion means comprises an integral member with said fingers being defined by slits in said member, and said member having a rectangular inlet proximate upper ends of said fingers.

35. Apparatus for dispensing product into pouches and comprising:

a horizontally mounted, rotatable filler wheel;

means for moving pouches about a portion of said filler wheel;

at least one product dispenser mounted on and rotating with said filler wheel for receiving product as it is dropped from a product supply means;

said product dispenser including a product accumulation means for receiving product from a product supply station, holding product, transporting product to a product filling station, and dropping said product into registered pouches at said filling station;

said product accumulation means comprising a funnel having an opening defined at a lower end, a plug mounted independently of said funnel proximate the lower end thereof and having a periphery sized to engage the lower end of said funnel to close said opening, and said plug and said funnel being mounted for selective relative movement apart such that said plug and said opening are spaced apart to open said opening and to drop product from said funnel into said pouches.

36. Apparatus as in claim 35 wherein relative movement apart of said funnel opening and said plug at least partially and temporarily lifts product away from said opening.

37. A method of dispensing product into pouches and comprising the steps of:

(a) conveying pouches about a portion of a filler wheel mounted for rotation in one direction and having at least one pouch filling station;

(b) depositing product in a product dispensing means from a hopper wheel rotating in a counter direction;

(c) accumulating product in product dispensing means mounted on said filler wheel above said pouches;

(d) rotating said filler wheel to register said product dispensing means over a pouch located at a filling station; and (e) releasing said product from said product dispensing means into said pouch.

38. A method as in claim 37 including the steps of accumulating product in said dispensing means not disposed over a pouch and in other product dispensing means disposed over a pouch.

39. A method as in claim 37 including the step of feeding said product dispensing means in multiple positions about said filler wheel, at least one of which positions is at a location where said filler wheel is free of pouches.

40. A method of dispensing product into pouches and comprising the steps of:

(a) conveying a pouch to a pouch filling station;

(b) partially opening the top of said pouch as said pouch reaches said pouch filling station;

(c) inserting at least a lower portion of an expandable cone means having at least three distinct, expandable sidewall portions into the partially open top of said pouch;

(d) inserting a tubular end portion of a product discharge funnel into said expandable cone means thereby expanding said sidewall portions at said lower portion of said expandable cone means to expand said pouch top, (e) dropping product through said expandable cone means and into said pouch; and, (f) sealing the top of said pouch.

41. The method of claim 40 wherein:

step (e) further includes dropping product through said product discharge funnel and said expandable cone means into said pouch.

42. A method of dispensing product into pouches travelling along a pouch conveyor comprising the steps of:

(a) accumulating product at an accumulation station in a product dispensing means and moving in a path, said station having expanding means for opening a pouch, said expanding means located at a lower portion of said product dispensing means and said accumulating steps including feeding said accumulation station from a hopper means mounted for rotation over only a segment of said path;

(b) conveying pouches to a pouch filling station;

(c) moving said product dispensing means from said accumulation station to said pouch filling station to register said expanding means over a pouch on said pouch conveyor;

(d) lowering said expanding means at least partially into said pouch;

(e) activating said expanding means to expand said pouch; and, (f) releasing said product from said product dispensing means into said pouch.

43. The method of claim 42 wherein said product dispensing means is mounted on a rotatable filler wheel positioned adjacent said pouch conveyor and step (c) further comprises:

rotating said filler wheel to move said product dispensing means from said accumulation station to said pouch filling station.

44. A method of dispensing product into pouches travelling along a pouch conveyor comprising the steps of:

(a) accumulating product at an accumulation station in a product dispensing means having expanding means for opening a pouch, said expanding means located at a lower portion of said product dispensing means;

(b) conveying pouches to a pouch filling station;

(c) moving said product dispensing means from said accumulation station to said pouch filling station to register said expanding means over a pouch on said pouch conveyor;

(d) lowering said expanding means at least partially into said pouch;

(e) activating said expanding means to expand said pouch; and, (f) releasing said product from said product dispensing means into said pouch;

wherein said product dispensing means includes an upper, slidably mounted discharge funnel having a lower tubular portion and said expanding means is an expandable cone having an upper generally circular-shaped open end and a lower, expandable apex end, said lowering and activating steps respectively, of the method further comprising:

(i) lowering said apex end of said expandable cone at least partially into said pouch; and, (ii) lowering said tubular portion of said discharge funnel into said expandable cone to expand said apex end and thereby expand said pouch.

45. A method of expanding an open end of a pouch during a pouch filling operation comprising:

(a) inserting at least a lower portion of a pouch expander means into said pouch open end; and, (b) inserting at least a lower portion of a funnel into said pouch expander means to expand said pouch expander means and to expand the mouth of said pouch.

46. The method of claim 45 wherein said lower portion of said funnel is cylindrically shaped, and wherein said pouch expander means comprises an expandable cone, and the method further comprises inserting the cylindrically shaped lower portion of said funnel into said expandable cone to expand said pouch open end into a circular configuration.

47. A method of dispensing product into pouches and comprising the steps of:

(a) conveying a pouch to a pouch filling station;

(b) partially opening the top of said pouch as said pouch reaches said pouch filling station;

(c) inserting at least a lower portion of an expandable cone means into the partially open top of said pouch;

(d) inserting at least the lower portion of a funnel into said cone means to expand said cone means and said pouch top; and (e) dropping product through said cone means and into said pouch.

48. A method of filling pouches entrained at locations about an arcuate segment of a pouch filler wheel rotating about a first axis and including the steps of:

entraining a plurality of pouches onto and away from said arcuate segment, receiving pouches on said wheel and removing pouches from said wheel after moving them through said arcuate segment, filling a product accumulation means moving with said wheel from a hopper wheel rotating about a second axis spaced from said first axis and rotating counter to said pouch filler wheel; and selectively releasing product from said accumulation means into pouches disposed thereunder when said pouches and said accumulation means are disposed in an angular sector corresponding to said arcuate segment.

said feeding step including feeding said accumulation means at positions disposed in angular sectors over said filler wheel free of pouches.

49. A method as in claim 48 wherein said method includes the steps of feeding said accumulation means disposed in angular sectors over said filler wheel having pouches therein.

50. A method as in claim 49 including the steps of:

releasing product from said accumulation means to drop product into said pouches throughout movement of said accumulation means through said angular sector corresponding to arcuate segment of said filler wheel.

51. Apparatus for dispensing product into pouches and comprising:

a rotatable filler wheel for supporting a plurality of pouches thereabout in positions at a selected pitch;

a plurality of accumulating chambers, one for each pouch pitch, mounted for rotation in a path about a first axis and above said pouch positions for receiving product from a product feeding apparatus disposed proximate said filler wheel;

a snake plate beneath said chambers for sealing said chambers against discharge of product therein and having a discharge slot for dropping product from said chambers as said chambers are moved thereover; and wherein said feeding apparatus comprises a plurality of hoppers disposed about a hopper wheel rotating in a second path about a feed axis offset from said first axis such that said hoppers traverse a path intersecting a portion of path of rotation of said chambers.

52. Apparatus as in claim 51 wherein said intersecting portions of said paths are spaced away from said discharge slot.

53. Apparatus as in claim 52 further including a plurality of spouts mounted respectively below said chambers for rotation of said pouches about said filler wheel whereby lower ends of said spouts are inserted into registered pouch through a sector of rotation of said filler wheel and spouts by virtue of said converging planes.

54. Apparatus as in claim 53 including a plurality of feeding apparatus disposed about said filler wheel.

55. Apparatus for dispensing product into pouches and comprising:

a rotatable filler wheel for supporting a plurality of open pouches thereabout in positions, at a selected pitch, to receive product;

a plurality of chambers, one for each pouch pitch, mounted for rotation in a first path about a first axis and above said pouch positions for receiving and passing product from a product feeding apparatus disposed proximate an arc of said filler wheels;

a plurality of hoppers disposed on a hopper wheel rotating in a second path about an axis offset from the first axis;

said first and second paths being coextensive at a position where said chamber is open at an upper end for receiving product from a hopper and is open at the same time at a lower end for dropping said product into an open pouch in register thereunder.

* * * * *